US009658602B2

(12) United States Patent
Von Burg

(10) Patent No.: US 9,658,602 B2
(45) Date of Patent: May 23, 2017

(54) WATCHCASE WITH MANUALLY ROTATABLE RING

(71) Applicant: Julian Von Burg, Grenchen (CH)

(72) Inventor: Julian Von Burg, Grenchen (CH)

(73) Assignee: J.R. INTERNATIONAL GMBH (CH)

( * ) Notice: Subject to any disclaimer, the term of this patent is extended or adjusted under 35 U.S.C. 154(b) by 0 days.

(21) Appl. No.: 14/277,881

(22) Filed: May 15, 2014

(65) Prior Publication Data

US 2014/0341004 A1 Nov. 20, 2014

(30) Foreign Application Priority Data

May 17, 2013 (EP) ..... 13168302

(51) Int. Cl.
*G04B 47/04* (2006.01)

(52) U.S. Cl.
CPC ..... *G04B 47/046* (2013.01); *G04B 47/044* (2013.01)

(58) Field of Classification Search
CPC ..... G04B 19/28; G04B 19/283; G04B 37/00; G04B 37/12; G04B 47/044; G04B 47/046
See application file for complete search history.

(56) References Cited

U.S. PATENT DOCUMENTS 2,547,140 A * 4/1951 Schmitz ..... G04B 27/086 368/190
3,064,415 A * 11/1962 Raymond Polo ..... G04B 27/02 368/191
3,499,280 A * 3/1970 Erard ..... G04B 27/02 368/190
3,665,701 A * 5/1972 Burdet ..... 368/295
3,879,933 A * 4/1975 Ikehata ..... G04B 27/02 368/191
4,223,521 A * 9/1980 Saitoh ..... G04B 3/02 368/185
4,253,177 A * 2/1981 Hafner ..... G04C 3/007 368/187
4,362,395 A * 12/1982 Calabrese ..... G04B 37/068 368/146
5,572,489 A * 11/1996 Born et al. ..... 368/21
5,654,941 A * 8/1997 Joss ..... 368/295
(Continued)

FOREIGN PATENT DOCUMENTS

CH 670 186 5/1989
EP 1 890 203 A1 2/2008
(Continued)

OTHER PUBLICATIONS

European Search Report dated Nov. 6, 2013 issued in corresponding European patent application No. EP 13 16 8302.
(Continued)

*Primary Examiner* — Sean Kayes
(74) *Attorney, Agent, or Firm* — Ostrolenk Faber LLP

(57) ABSTRACT

The watchcase includes a top portion (11) for holding a watchglass (1), a case back (40), and a case middle (10) with a circumferential case wall (12) arranged between the top portion and the case back. The watchcase further includes at least one ring (20), which extends around the case wall (12) and is rotatably arranged with respect to the case wall (12). The at least one ring (20) is arranged such that it accessible from the outside for a manual rotation.

18 Claims, 7 Drawing Sheets

(56) References Cited

U.S. PATENT DOCUMENTS

| | | | | |
|---|---|---|---|---|
| 6,379,037 | B1 * | 4/2002 | Saleh | G04B 27/08 368/185 |
| 6,579,004 | B1 * | 6/2003 | Kim | G04B 19/23 368/21 |
| 6,799,886 | B2 | 10/2004 | Carrard | 368/281 |
| 2003/0206493 | A1 * | 11/2003 | Carrard et al. | 368/10 |
| 2004/0141424 | A1 * | 7/2004 | Hartmann et al. | 368/295 |
| 2004/0161015 | A1 * | 8/2004 | Kaiser | G01K 5/70 374/187 |
| 2006/0114753 | A1 * | 6/2006 | Gerber | 368/295 |
| 2006/0193210 | A1 * | 8/2006 | Damasko | 368/295 |
| 2008/0013408 | A1 * | 1/2008 | Meerovitsch | G04B 27/08 368/190 |
| 2008/0279053 | A1 * | 11/2008 | Robert-Nicoud | G04B 45/00 368/295 |
| 2012/0111665 | A1 | 5/2012 | Paglioli | 182/5 |
| 2013/0182544 | A1 * | 7/2013 | Netuschill | 368/280 |
| 2013/0201804 | A1 * | 8/2013 | Bertrand et al. | 368/281 |

FOREIGN PATENT DOCUMENTS

| | | | |
|---|---|---|---|
| EP | 1 730 607 | A1 | 12/2011 |
| JP | S55-97471 | U | 7/1980 |
| WO | WO 02/44818 | A1 | 6/2002 |
| WO | WO 2005/093528 | A1 | 10/2005 |
| WO | WO 2009/006645 | A1 | 1/2009 |
| WO | WO 2011/007225 | A1 | 1/2011 |

OTHER PUBLICATIONS

Mexican Office Action, dated Jul. 14, 2016, issued in corresponding Mexican Patent Application No. MX/A/2014/005834. Partial English Translation. Total 4 pages.

European Search Report, dated May 31, 2016, issued in corresponding European Patent Application No. EP14168418. Total 3 pages.

* cited by examiner

FIG. 10
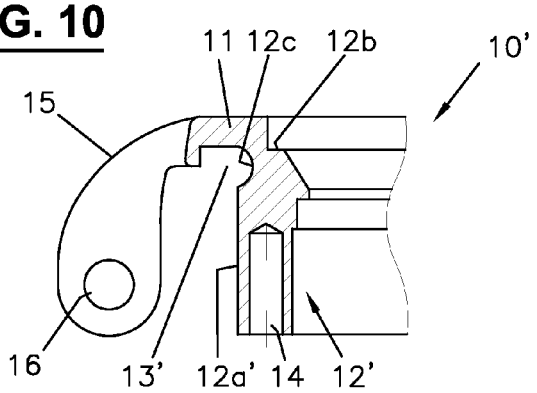
FIG. 11
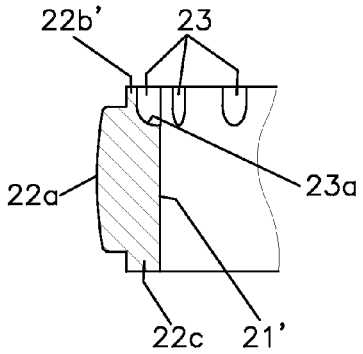
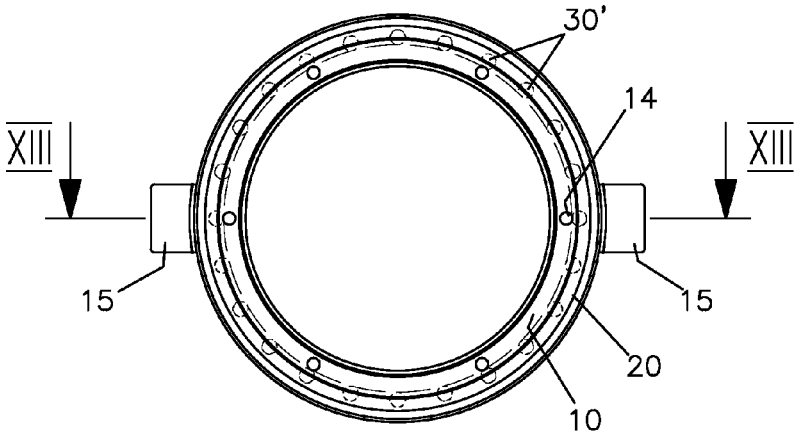
FIG. 12
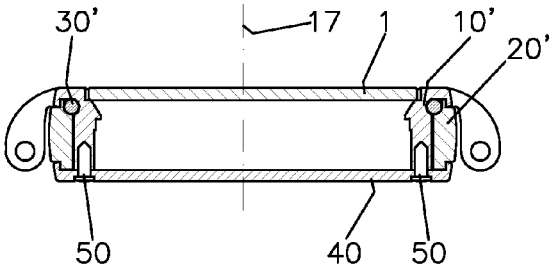
FIG. 13
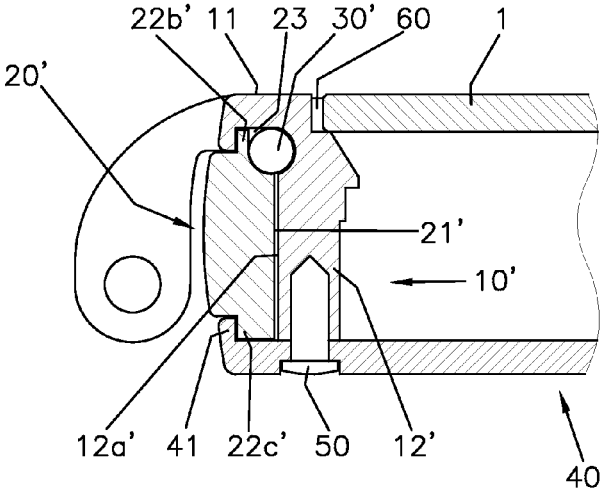
FIG. 14

WATCHCASE WITH MANUALLY ROTATABLE RING

BACKGROUND

The present invention relates to a watchcase comprising a case middle with a circumferential case wall arranged between a top portion and a case back.

Various watchcases are known, see e.g. EP 1 730 607 A1. To change the appearance of a watchcase, elements are to be added or removed, which is relatively complicated.

The patent CH 670 186 G A3 discloses a watch including a ring, which is arranged rotatably inside the watchcase between the case middle and an intermediate part. The ring is not accessible from the outside so that a rotation of the ring to a specific position is not possible for the user.

SUMMARY

It is an aim of the present invention to provide for a watchcase which allows its appearance to be changed in a simplified and improved manner.

This aim is achieved with a watchcase which comprises a case middle with a case wall and at least one rotatable ring with an inner side extending around the case wall and an outer side opposite to the inner side, so that the at least one ring is accessible from the outside for a manual rotation. The provision of such a rotatable ring allows a change of the appearance by simply rotating the ring.

BRIEF DESCRIPTION OF DRAWINGS

The invention is explained in the following by means of exemplary embodiments with reference to Figures. In the drawings:

FIG. 10 shows part of the case middle of the watchcase according to FIG. 9 in a sectional side view;

FIG. 11 shows part of the ring used in the watchcase of FIG. 9 in a sectional side view;

FIG. 12 shows a bottom view of the components of FIG. 9 in the assembled state without the case back;

FIG. 13 shows the assembled watchcase of FIG. 9 in a partial section along the line XIII-XIII in FIG. 12;

FIG. 14 is an enlarged view of the left part of FIG. 13;

DETAILED DESCRIPTION

First Exemplary Embodiment

Figure 1:
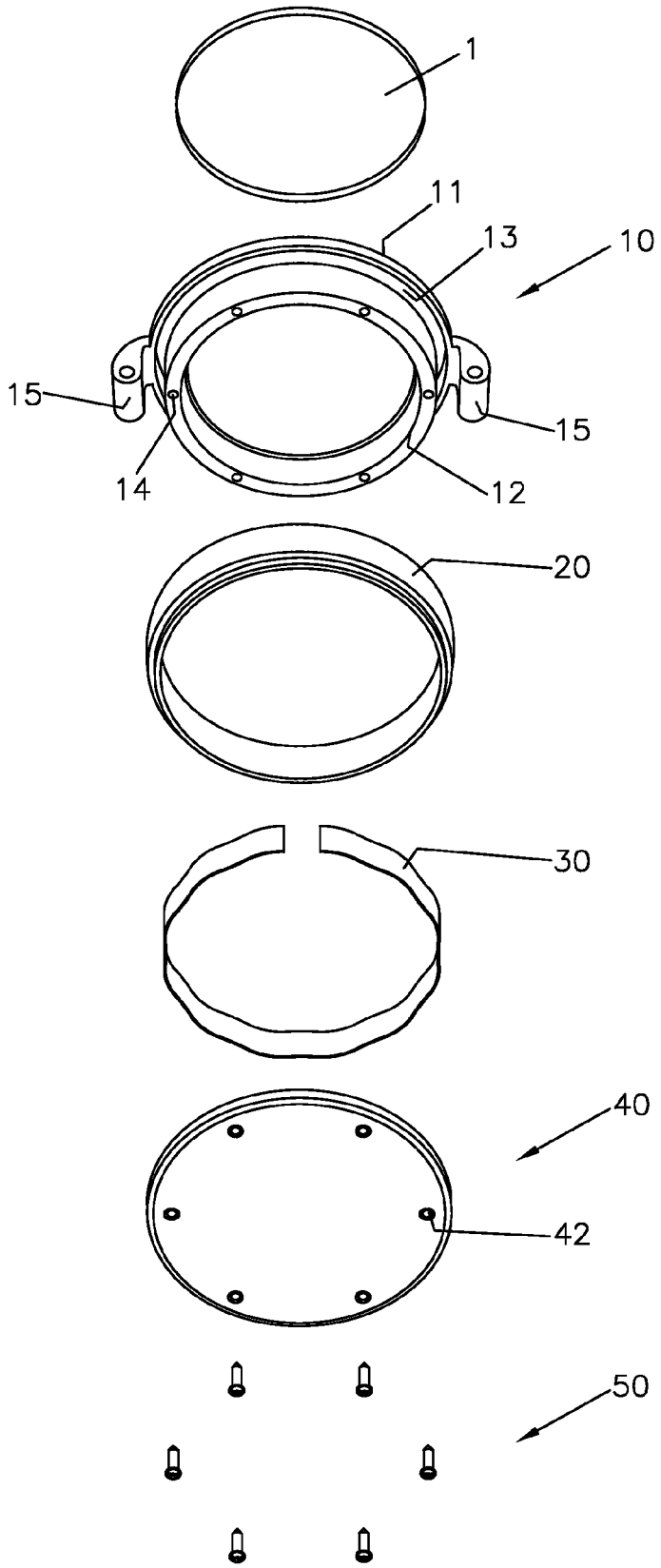
FIG. 1 shows an explosion view of a first embodiment of a watchcase according to the invention.

FIG. 1 shows an explosion view of a first embodiment of a watchcase which is typically part of a wrist watch. The watchcase comprises a case cover 1 in form of a watchglass, a case middle 10 with a rotatable ring 20 and a spring element 30, and a case back 40. The parts 1, 10, 40 form a case, in which the clockwork-movement and the time indicating means (both not shown) are arranged. In this embodiment, the clockwork-movement is fixable to the case middle 10.

Figure 2:
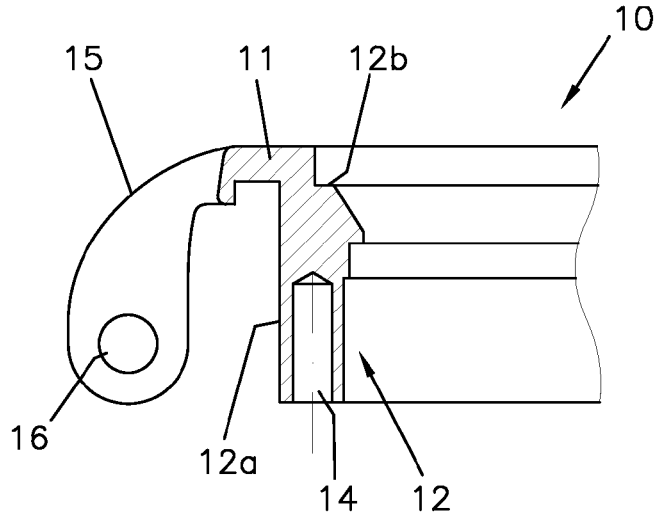
FIG. 2 shows part of the case middle of the watchcase according to FIG. 1 in a sectional side view.

As can also be seen from FIG. 2, the watchcase comprises a case middle 10 having a circumferential case wall 12 and a top portion 11, which forms the bezel for holding the watchglass 1. The top portion 11 is formed such that it surrounds the watchglass 1. In this embodiment, the case wall 12 and the top portion 11 are formed in one piece. It is also conceivable, to fabricate them in two or more separate pieces which can be assembled.

The ring 20 is rotatable with respect to the case wall 12 and to the top portion 11.

The case middle 10 has a circumferential outer surface 12*a*, which is substantially circular cylindrical, and a circumferential groove 13, which is formed on the underside of the top portion 11. The groove 13 serves for holding and guiding the ring 20. The inner surface 12*b* of the case middle 10 has a stepped design on the top to form a seat 12*b* for the watchglass 1.

The case wall 12 comprises several bores 14, each extending from the bottom end of the case wall 12 into its inside. Each bore 14 serves for receiving the end of a fixation screw 50 to detachably attach the case back 40 to the case middle 10. For that purpose, the bores 14 may comprise an internal thread.

Figure 6:
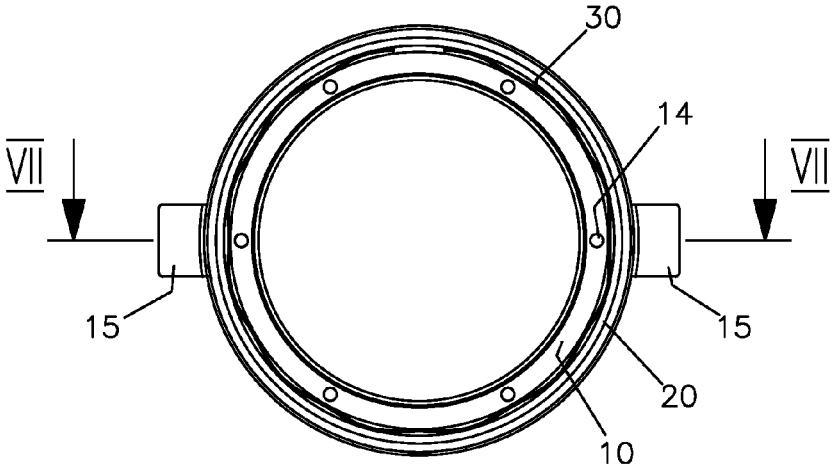
FIG. 6 shows a bottom view of the components of FIG. 1 in the assembled state without the case back.

As can also be seen from FIG. 6, the case middle 10 comprises two attachment portions 15 which are arranged substantially opposite to each other. Each attachment portion 15 is connected to the top portion 11 and projects laterally over the case wall 12 such that it is spaced away from the outer surface 12*a* in order to arrange the ring 20 between the attachment portions 15 and the outer surface 12*a*. Thereby, the attachment portions 15 extend at least partially over the ring 20. The attachment portions 15 comprise means for attaching the ends of a watchband (not shown). In the present embodiment, each attachment portion 15 has a through-hole 16 for receiving a rod or the like on which an end of the watchband can be fixed.

Figure 3:
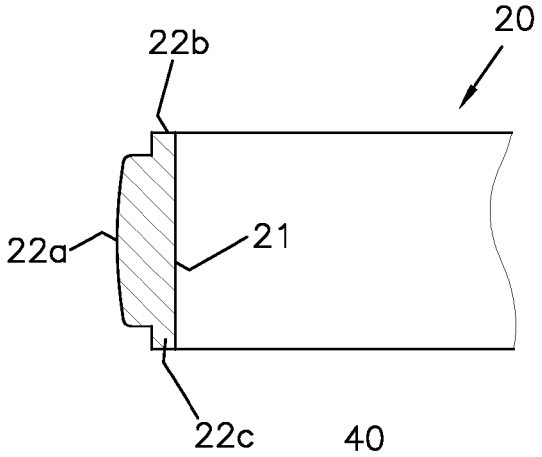
FIG. 3 shows part of the ring used in the watchcase of FIG. 1 in a sectional side view.

As can also be seen from FIG. 3, the ring 20 has an inner surface 21, which is substantially circular cylindrical, and an outer surface having a middle portion 22*a* which is arranged between a stepped top end 22*b* and stepped bottom end 22*c*. The middle portion 22*a* can have a different form than shown here and it may be provided with one or more decorative and/or jewelry elements. The ring 20 may also have a functional purpose, for instance information may be displayed on the periphery of the ring 20. The latter can be fabricated of different materials, e.g. metal, plastic material, etc.

Figure 4:
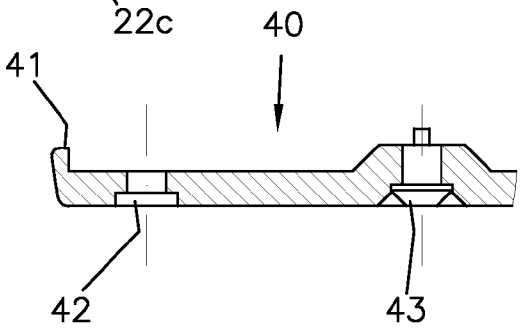
FIG. 4 shows part of the case back used in the watchcase of FIG. 1 in a sectional side view.

As shown in FIG. 4 the case back 40 has a raised edge 41 to form a wall for holding and guiding the ring 20. The case back 40 includes several through-holes 42 through which the end of fixation screws 50 can be passed to attach the case back 40 to the case middle 10. The through-holes 42 have a stepped design in order to countersink the head of a fixation screw 50.

Furthermore, the case back 40 is configured to receive an actuating mean 43, for instance a push-piece, for adjusting the clockwork-movement. For this purpose, the case back 40 comprises a through-hole for receiving the actuating mean 43. The through-hole is configured such that the head of the actuating mean 43 is countersunk.

Figure 5:
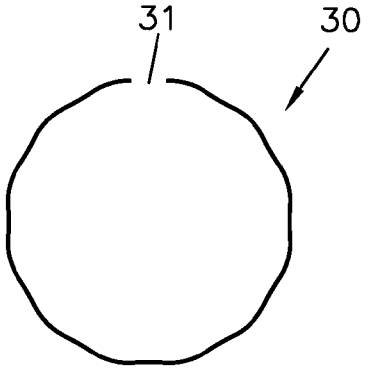
FIG. 5 shows the spring element used in the watchcase of FIG. 1 in a top view.

The spring element 30 is built essentially as a bent strip and has an undulating form. As can also be seen from FIG. 5, the spring element 30 has a gap 31 such that their two ends are spaced away from each other. The spring element 30 is made from a suitable material, e.g. metal, to provide for the desired elasticity.

Figure 7:
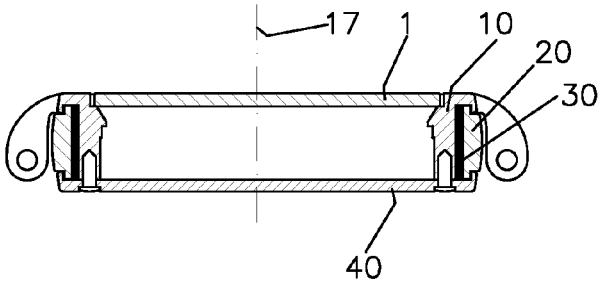
FIG. 7 shows the assembled watchcase of FIG. 1 in a partial section along the line VII-VII in FIG. 6.
Figure 8:
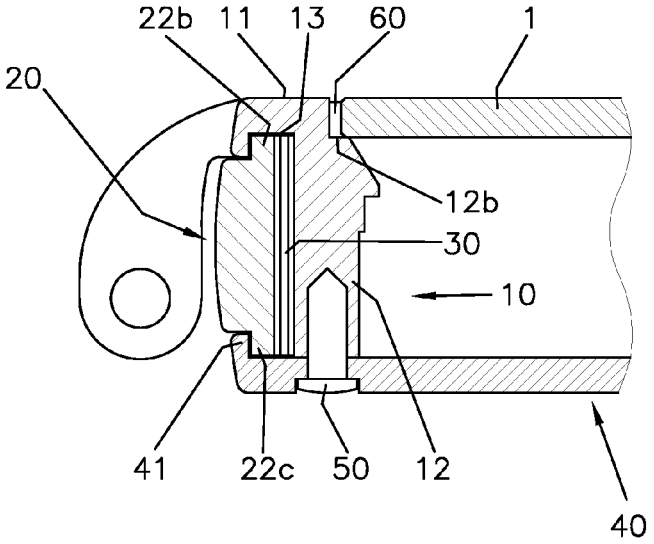
FIG. 8 is an enlarged view of the left part of FIG. 7.

FIGS. 6-8 show the watchcase in the assembled state. The watchglass 1 is positioned on the step 12*b* of the case middle 10. A circular joint 60 is arranged between the top portion 11 and the watchglass 1 to provide for a sealed case. The case back 40 is attached to the case middle 10 by means of the screws 50.

The ring 20 is arranged coaxially to the case middle 10. The stepped top end 22*b* of the ring 20 engages the groove 13 and the stepped bottom end 22*c* of the ring 20 engages in the groove built by the raised edge 41 and the case wall 12.

The spring element 30 is arranged in the space between the ring 20 and the case middle 10. Due to its undulating form the spring element 30 contacts alternately the inner surface 21 of the ring 20 and the outer surface 12*a* of the case middle 10 (see FIG. 6).

The ring 10 can be freely rotated with respect to the case middle 10 around an axis 17 around which the case wall 12 extends. The axis 17 is arranged transversally to the watchglass 1 and the case back 40. The rotation can be in both directions, clockwise and anticlockwise, and more than 360 degrees. The spring element 30 exerts a force on the ring 20 such that the rotational play is reduced.

Second Exemplary Embodiment

Figure 9:
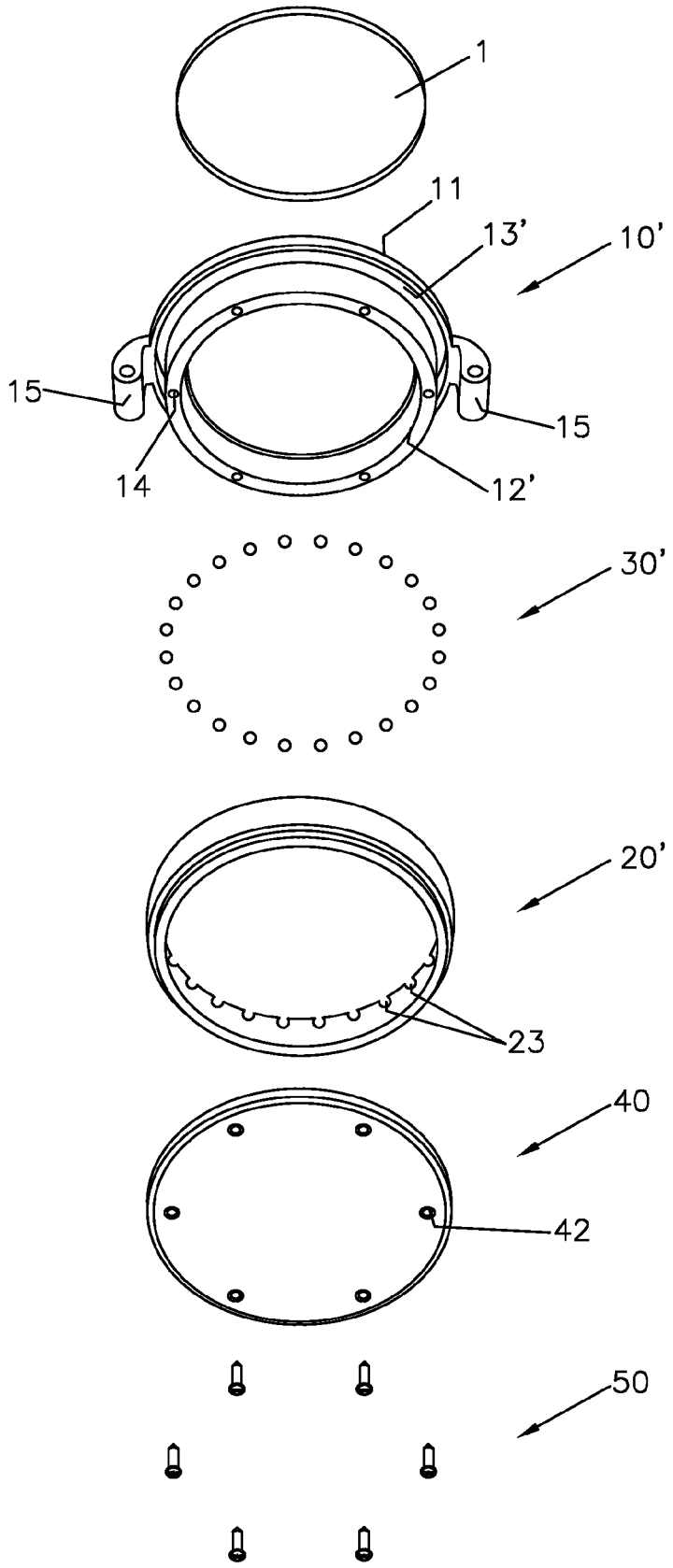
FIG. 9 shows an explosion view of a second embodiment of a watchcase according to the invention.

FIG. 9 shows an explosion view of a second embodiment of a watchcase for a wrist watch. Elements which are the same as in the first embodiment are denoted by the same reference signs. The main difference is the rotatable arrangement of the ring 20'. In the present embodiment, a ball bearing is used for allowing a free rotation of the ring 20' around the axis 17.

The case middle 10 comprises the top portion 11 and a case wall 12'. As can be best seen in FIG. 10, the groove 13' which is formed on the underside of the top portion 11 includes a circumferential recess 12*c* built on the top of the outer surface 12*a'* of the case wall 12'. The recess 12*c* has a cross-section which is substantially circular and serves for receiving a portion of a ball 30'.

As can be seen from FIGS. 9 and 11, the ring 20' has an inner surface 21' with a substantially circular cylindrical surface section in which cavities 23 are formed on the top end 22*b'*. The cavities 23 are distributed along the ring 20', wherein the distance between the cavities 23 may vary or be the same. Each cavity 23 is formed such that it comprises a bottom surface 23*a* which is substantially spherical for receiving a portion of a ball 30'.

In the assembled state as shown in FIGS. 12-14 balls 30' are placed in the cavities 23. When the ring 20' is rotated, the balls 30' roll along the recess 12*c*. The space between the inner surface 21' of the ring 20' and the outer surface 12*a'* of the case wall 12' may be smaller than in the first embodiment and it may be that the surfaces 12*a'* and 21' contact each other at least partially.

As in the first embodiment, the rotation of the ring 20' can be in both directions, clockwise and anticlockwise.

Third Exemplary Embodiment

Figure 15:
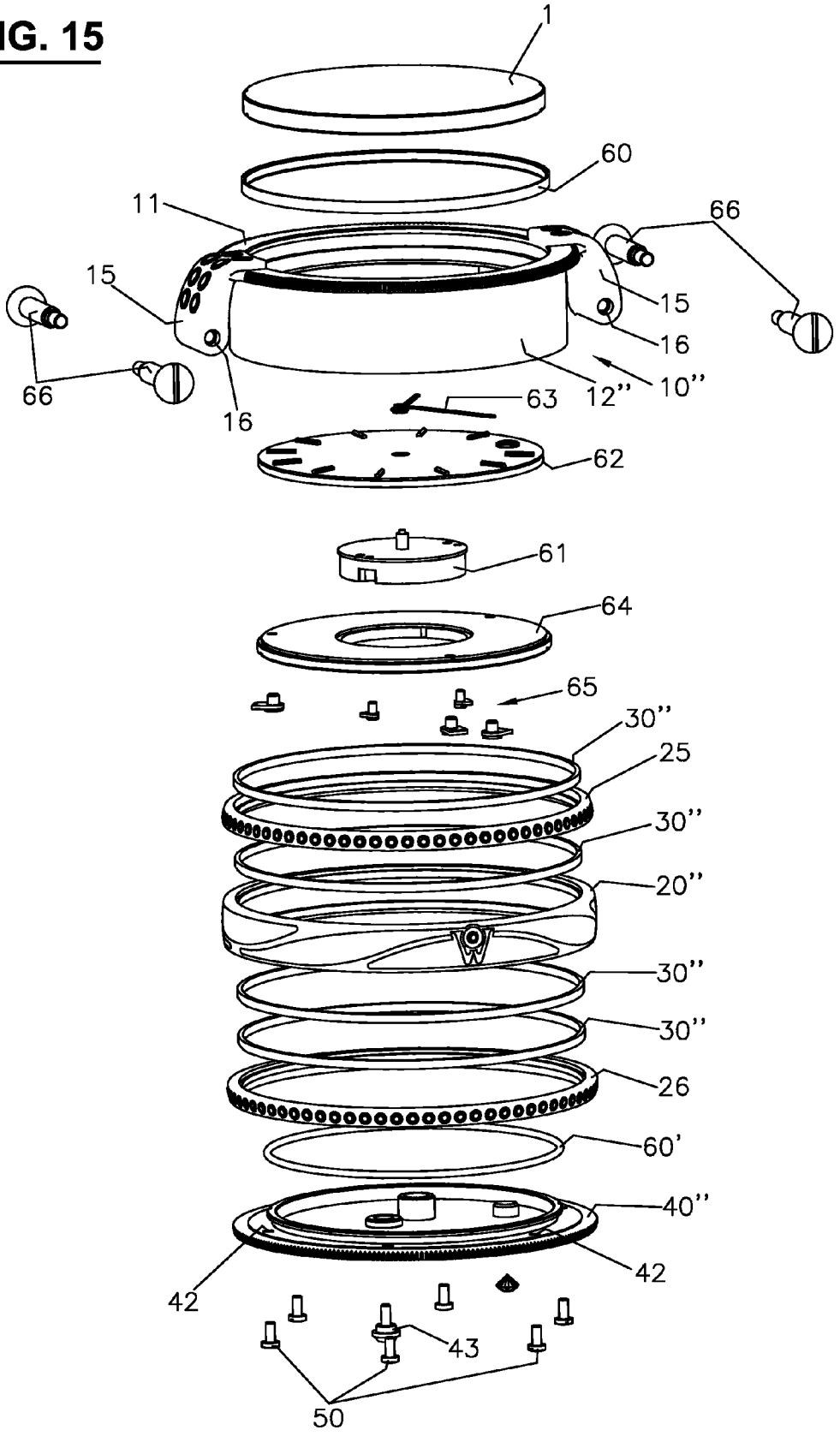
FIG. 15 shows an explosion view of a watch including a third embodiment of a watchcase according to the invention.

FIG. 15 shows an explosion view of a watch comprising a third embodiment of a watchcase. Elements which are the same as in the first embodiment are denoted by the same reference signs. The main difference is in the provision of more than one rotatable ring 20", 25, 26.

The watchcase comprises a watchglass 1 held by a top portion 11, a case middle 10" with rings 20", 25, 26, and a case back 40". The parts 1, 10", 40" form a case, in which the clockwork-movement 61 and the time indicating means 62, 62 are arranged. The latter are e.g. a dial 62 with hands 63. A ringlike element 64 is used to hold the dial 62 and the clockwork-movement 61 and to fix them to the case middle 10" by means of screws, braces and/or other attachment means 65.

Figure 16:
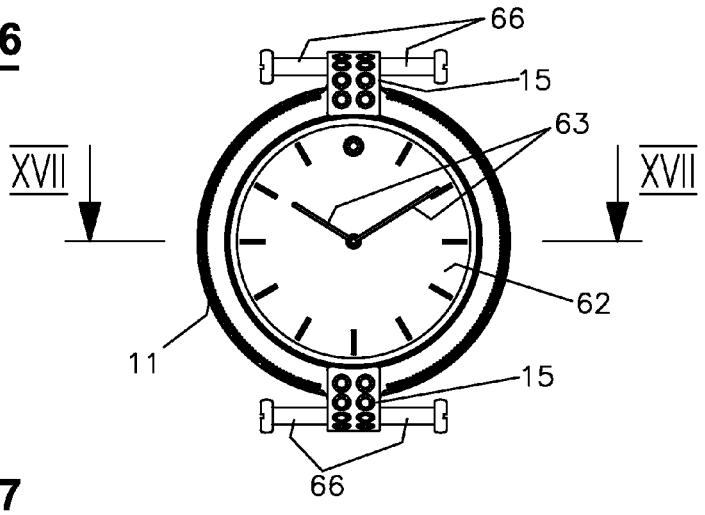
FIG. 16 is a top view of the watch according to FIG. 15 in the assembled state.

FIG. 15 also shows a circular joint 60' for sealing the connection between the case middle 10" and the case back 40" and fixation screws 66 which can be screwed into the holes 16 formed in the attachment portions 15 so as to attach a watchband to the watchcase (see also FIG. 16).

Figure 17:
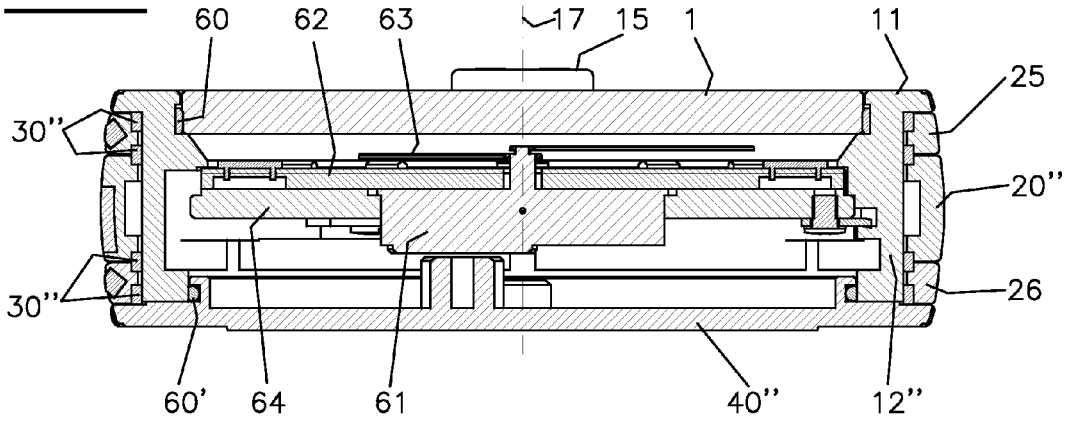
FIG. 17 shows the assembled watch of FIG. 16 in a section along the line XVII-XVII in FIG. 16.
Figure 18:
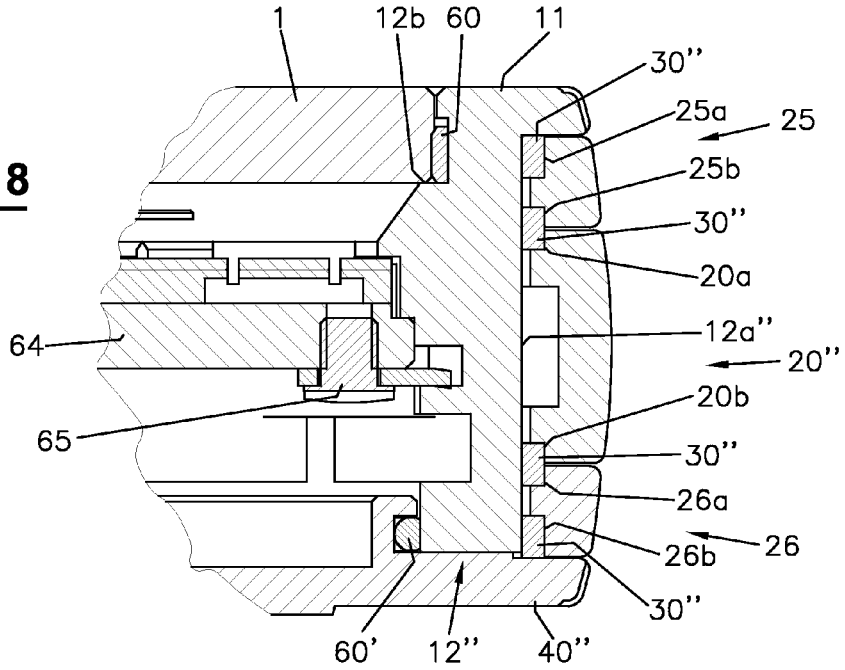
FIG. 18 is an enlarged view of the right part of FIG. 17.

As can also be seen from FIGS. 17 and 18, the case middle with the top portion 11 and with the case wall 12" has a suitable designed inner side for holding the watchglass 1 and the elements 61-65.

The outer surface 12*a"* of the case wall 12" has a substantially L-shaped cross-section. The case back 40" extends laterally over the lower end of the case wall 12", so that it forms together with the top portion 11*a* groove in which the rings 20", 25, 26 and bearing means 30" for rotatably arranging the rings 20", 25, 26 are received. In the embodiment shown here, friction elements 30", which are arranged between the inner side of the rings 20", 25, 26 and the outer surface 12*a"* of the case wall 12", are used as bearing means.

Each friction element 30" is formed as a ring and has e.g. a substantially rectangular cross-section.

The inner surface of each ring 20", 25, 26 has a stepped design along the upper and lower side (see steps 20*a*, 20*b* of ring 20", steps 25*a*, 25*b* of ring 25 and steps 26*a*, 26*b* of ring 26 in FIG. 18). The rings 20", 25, 26 lie via these steps 20*a*, 20*b*, 25*a*, 25*b*, 26*a*, 26*b* on the friction elements 30".

In the embodiment shown here, two rings 25 and 26 are arranged adjacent to the middle ring 20". The rings 20", 25, 26 can be rotated independently of each other around the rotation axis 17 in both directions, clockwise and anticlockwise.

In each embodiment shown here, the case wall (12; 12'; 12") includes an inner side facing inwards for surrounding a clockwork movement (61) and an outer side (12*a*; 12*a'*; 12*a"*) being opposite of the inner side and facing outwards. A ring (20', 20' 20", 25, 26) comprises an inner lateral side (21*a*), which is rotatably arranged around the outer side (12*a*; 12*a'*; 12*a"*) of the case wall (12; 12'; 12"), and an outer lateral side (22*a*), which is opposite to the inner lateral side (21*a*). The outer lateral side (21*a*) of the ring (20', 20' 20", 25, 26) is visible from the outside and it is accessible for the user for a manual rotation.

From the preceding description, many modifications are available to the skilled person without departing from the scope of the invention, which is defined in the claims.

The spring element of the first embodiment may have a different form, e.g. it may be formed from a bent wire. In the second embodiment other bearing bodies, e.g. rollers can be used as a bearing for the ring. It also conceivable to combine both embodiments by applying a bearing and a spring element or to use other or additional means to arrange the ring rotatably on the middle case.

Furthermore, it is conceivable to provide for a detent mechanism, which defines specific angular positions, at which the ring is hold. In order to move the ring into another angular position, a force exceeding a certain threshold is to be applied.

In the third embodiment the watchcase comprises three rotatable rings. Depending on the design of the watchcase, the number of rotatable rings can be one, two or more. Each ring may be rotatably arranged by use of bearing means, which comprise e.g. at least one of a spring element (30), a rolling bearing (30'), a friction element (30") and other elements.

The decorative and jewelry elements shown for the third embodiment are for illustrative purposes and can be left away or designed differently.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A watchcase comprising a top portion for holding a watchglass, a case back, and a case middle with a circumferential annular case wall, wherein the annular case wall extends without interruption from the top portion to the case back, defining an unpierced surface, the case middle having a midplane defined between the top portion and the case back and parallel therewith, and at least one ring, which is rotatably arranged with respect to the case wall, wherein the at least one ring comprises an inner side, which extends around the unpierced surface of the case wall and has a bottom edge that is arranged below said midplane, and an outer side, which is opposite to the inner side and thereby accessible to a user so as to be manually rotatable by the user, wherein the case back has a through-hole to receive an actuating device for adjusting a clockwork-movement inside the watchcase, wherein the actuating device protrudes through the case back and thereby can be actuated from outside the watchcase for adjusting the clockwork-movement, wherein the actuating device does not project from the through-hole beyond an outer surface of the case back.

2. The watchcase according to claim 1, wherein a lateral portion of the case middle defines a circumferential groove for receiving a portion of the at least one ring.

3. The watchcase according to claim 2, wherein the circumferential groove is disposed beneath an underside of the top portion.

4. The watchcase according to claim 2, wherein the circumferential groove is disposed above a top side of the bottom portion.

5. The watchcase according to claim 1, wherein the case back comprises a raised edge for at least one of holding and guiding the at least one ring.

6. The watchcase according to claim 1, wherein the at least one ring comprises a stepped top end and a stepped bottom end.

7. The watchcase according to claim 1, further comprising a spring element arranged between the at least one ring and the case wall.

8. The watchcase according to claim 7, wherein the spring element has at least one of an undulating form and a gap.

9. The watchcase according to claim 1, further comprising a rolling bearing for rotatably mounting the at least one ring.

10. The watchcase according to claim 9, wherein the at least one ring comprises cavities for receiving at least partially rolling elements of the rolling bearing.

11. The watchcase according to claim 1, further comprising attachment portions for fastening a watchband thereto, the attachment portions projecting laterally at least partially over the at least one ring.

12. The watchcase according to claim 1, wherein the at least one ring has at least one of the following configurations:

the at least one ring is configured to serve as an indicator of information, the at least one ring comprises one or more decorative elements, the at least one ring comprises one or more jewellery elements.

13. The watchcase according to claim 1, wherein the case back is detachably connected to the case wall.

14. The watchcase according to claim 1, wherein the top portion is integrally connected to the case wall.

15. The watchcase according to claim 1, further comprising at least one friction element arranged between the at least one ring and the case wall.

16. The watchcase according to claim 1, comprising at least two rings, which extend around the case wall and which are rotatable around a rotation axis.

17. The watchcase according to claim 16, wherein the at least two rings are arranged offset to each other in the rotation axis.

18. A watch comprising the watchcase of claim 1.

* * * * *